US006095286A

United States Patent [19]

Citron et al.

[11] Patent Number: 6,095,286

[45] **Date of Patent: *Aug. 1, 2000**

[54] PERSONNEL LIFT WITH ADJUSTABLE SHIM WEAR BLOCKS

[75] Inventors: Steven D. Citron, Redmond; Ronald A. Teter, Kirkland; John Busuttil; Matthew G. Kraemer, both of Redmond; Ronald L. Williams, Woodinville, all of Wash.

[73] Assignee: Genie Industries, Inc., Redmond, Wash.

[ * ] Notice: This patent is subject to a terminal disclaimer.

[21] Appl. No.: 09/173,537

[22] Filed: Oct. 15, 1998

Related U.S. Application Data

[63] Continuation of application No. 08/787,871, Jan. 23, 1997, Pat. No. 5,850,892.

[51] Int. Cl.[7] ..... E04G 1/18

[52] U.S. Cl. ..... 182/148; 182/141; 187/230

[58] Field of Search ..... 182/63.1, 69.4, 182/69.6, 127, 141, 144, 146, 147, 148; 187/230, 238, 410

[56] References Cited

U.S. PATENT DOCUMENTS

| | | | |
|---|---|---|---|
| 1,905,626 | 4/1933 | Hershey | 182/141 X |
| 2,632,530 | 3/1953 | Wagner | 182/148 X |
| 2,762,659 | 9/1956 | Harlan et al. | 182/141 |
| 3,148,005 | 9/1964 | Pusztay | 187/238 X |
| 3,414,086 | 12/1968 | Ulinski | 187/230 |
| 4,015,686 | 4/1977 | Bushnell, Jr. | 182/148 |
| 4,234,057 | 11/1990 | Nakane et al. | 187/238 |
| 4,258,825 | 3/1981 | Collins | 182/148 X |
| 4,427,093 | 1/1984 | Wehmeyer et al. | 182/141 |
| 4,458,785 | 7/1984 | Bushnell, Jr. | 187/230 X |
| 4,752,102 | 6/1988 | Rasmussen | 182/141 X |
| 5,203,425 | 4/1993 | Wehmeyer | 182/148 X |
| 5,271,482 | 12/1993 | Walz | 182/148 X |
| 5,279,393 | 1/1994 | Lloyd | 187/410 |

*Primary Examiner*—Daniel P. Stodola
*Assistant Examiner*—Richard M. Smith
*Attorney, Agent, or Firm*—Perkins Coie LLP

[57] ABSTRACT

A personnel lift (20) having adjustable side-to-side shim assemblies (38*a–d*) used in conjunction with a series of slide blocks (39, 40) in the mast of the personnel lift. The mast of the personnel lift includes a number of nested columns (24*a–e*) that extend to lift a person and an aerial work platform (22) to a desired height. The shim assemblies (38*a–d*) and slide blocks (39, 40) are used to maintain the nested columns (24*a–e*) in proper alignment, and the shim assemblies (38*a–d*) are adjustable to account for wear. The adjustable features of the shim assemblies (38*a–d*) are accessible when the columns are fully assembled, which allows the shim assemblies (38*a–d*) to be adjusted without requiring that the mast be disassembled.

15 Claims, 3 Drawing Sheets

PERSONNEL LIFT WITH ADJUSTABLE SHIM WEAR BLOCKS

REFERENCE TO RELATED APPLICATION

This is a continuation of U.S. patent application Ser. No. 08/787,871, filed Jan. 23, 1997, now U.S. Pat. No. 5,850,892, incorporated herein by reference.

FIELD OF THE INVENTION

This invention is directed to personnel lifts and, more specifically, personnel lifts that have a tower of extendible, nested columns.

BACKGROUND OF THE INVENTION

Personnel lifts are presently used for a wide variety of applications. A typical personnel lift includes an aerial work platform that can be raised or lowered to position a worker at a desired height. The aerial work platform and the worker can be raised to a position where the worker can change light bulbs, work on fixtures, or paint overhead surfaces, for example.

In one personnel lift, the aerial work platform is attached to the upper end of an extendible mast and includes a personnel cage for containing a worker. The mast includes a number of extendible, nested columns mounted on a base supported by wheels. The mast and base are small so that a worker can easily roll the base to a desired location. Once the personnel lift is at the desired location, outriggers are set to stabilize the base. After the personnel lift has been adequately stabilized, a worker enters the personnel cage and operates controls to raise the aerial work platform.

The columns of prior art personnel lifts feature tracks, within which a runner on an adjacent column travels to raise or lower the aerial work platform. Each column is equipped with a plurality of rollers and/or slide surfaces that facilitate the movement of the runners within the tracks. The runners, rollers, slide surfaces, and tracks must fit precisely to permit smooth and unimpeded extension of the columns. Thus, the runner/track configuration requires a significant amount of machining. In addition, the rollers and slide surfaces must be adjusted or replaced as they wear so that the proper fit of the columns is maintained.

U.S. Pat. No. 5,203,425 to Wehmeyer et al. discloses a personnel lift device having a series of nested columns. A protrusion on one column of an adjacent pair of columns fits loosely within a substantially U-shaped slot on the adjacent column. Disposed between the protrusion and the U-shaped slot is at least one strip of low friction material. The strip of low friction material is attached to the protrusion and slides against the U-shaped slot as the columns move relative to one another. Although the strip of low friction material provides smooth sliding of one column relative to another, there is no provision for adjustment of the columns or the strip of material once the strip of material begins to wear away. Thus, after a number of cycles of the columns moving up and down relative to one another, a gap may exist between the U-shaped slot and the low friction material.

It has been found that once wear has begun, a gap tends to form between the strip of low friction material and the sliding surface of prior art mast systems of the type disclosed in Wehmeyer et al. The gap results in play between the columns that may cause the columns to lean in one direction or another. This leaning is a result of the strip of wear material wearing away, and the column shifting sideways. When the columns lean toward one side, the slide materials on that side of the column receive increased concentrated pressure. This increased pressure aggravates the problem, causing further wearing away of the strip of low friction material on the leaning side. Often, prior art personnel lifts require replacement of the wear surfaces to prevent any further leaning.

Replacement of wear surfaces in a prior art tower of nested columns often requires complete disassembly of the mast so that the wear surfaces may be accessed. This disassembly may involve hours of down time for the personnel lift, as well as costly maintenance repairs.

Another problem encountered in prior art masts is that the columns are difficult to assemble. As stated earlier, the machining of the columns must be within close tolerances, or the columns may not slide properly relative to one another. In addition, many of prior art masts utilize rollers on one column that fit within channels on an adjacent column. The rollers are made to fit snugly into the channels so as to prevent fore and aft movement of the columns. Often during assembly additional shim material must be added behind the rollers to press the front of the roller into the bottom of the channel so as to prevent side-to-side movement between the columns. Adapting the fit of the rollers so that the columns have the proper smooth movement relative to one another often requires several hours of adjustments that may include disassembly and reassembly of the columns. Thus there exists a need for a better, faster method of fitting such columns together.

In summary, there exists a need for a slide assembly for the extendible masts of personnel lifts that allows the columns of a mast to be quickly and easily aligned relative to one another and that can be easily adjusted to account for wear. The adjustment for wear of the slide assembly should not require disassembly of the mast.

SUMMARY OF THE INVENTION

In accordance with the present invention, a slide assembly for an extendible mast system is provided. The mast system includes a plurality of nested columns. One column of a pair of adjacent columns includes a runner that is received within and adapted to slide along a track on the other column. The slide assembly includes a shim block attached to the runner or the track of one column that is adapted to slide against an adjacent surface of the other element, i.e., the track or runner of the other column. A lock mechanism is provided on the slide assembly for locking the shim block in position. An adjustment mechanism is also provided that, when the lock mechanism has released the shim block, is capable of moving the shim block toward and away from the adjacent surface. The adjustment mechanism is accessible from the outside of the mast assembly when the mast assembly is fully assembled.

In accordance with other aspects of this invention, the shim block is mounted on the head of a bolt, and the adjustment mechanism includes the bolt, a threaded hole in the surface to which the shim block is attached, and a hex-key indentation in the distal end of the bolt.

In accordance with further aspects of this invention, the lock assembly includes a lock nut threaded onto the end of the bolt. The lock nut co-acts with the threaded hole to lock the shim block in position.

In accordance with other further aspects of this invention, the runner of one column includes sidewalls that are received within the outer walls of the track of the other column. The shim block is attached to one of the outer walls of the track and engages one of the sidewalls of the runner.

In accordance with still further aspects of this invention, the slide assembly further includes a first rib extending along the runner of one of the columns and a second rib extending along the track of the other column. A first slide block is attached to either the first rib or the other column and slides along the other of the first rib and the other column. Preferably, a second slide block is attached to either the second rib or the first column and slides along the other of the second rib and first column.

As will be readily appreciated from the foregoing description, a slide assembly formed in accordance with this invention is ideally suited for use as the mast of a personnel lift. Because the columns of the slide assembly do not have to disassemble in order to adjust the shim blocks, the columns of the mast can be quickly and easily aligned relative to one another during assembly and can be easily adjusted to compensate for wear.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
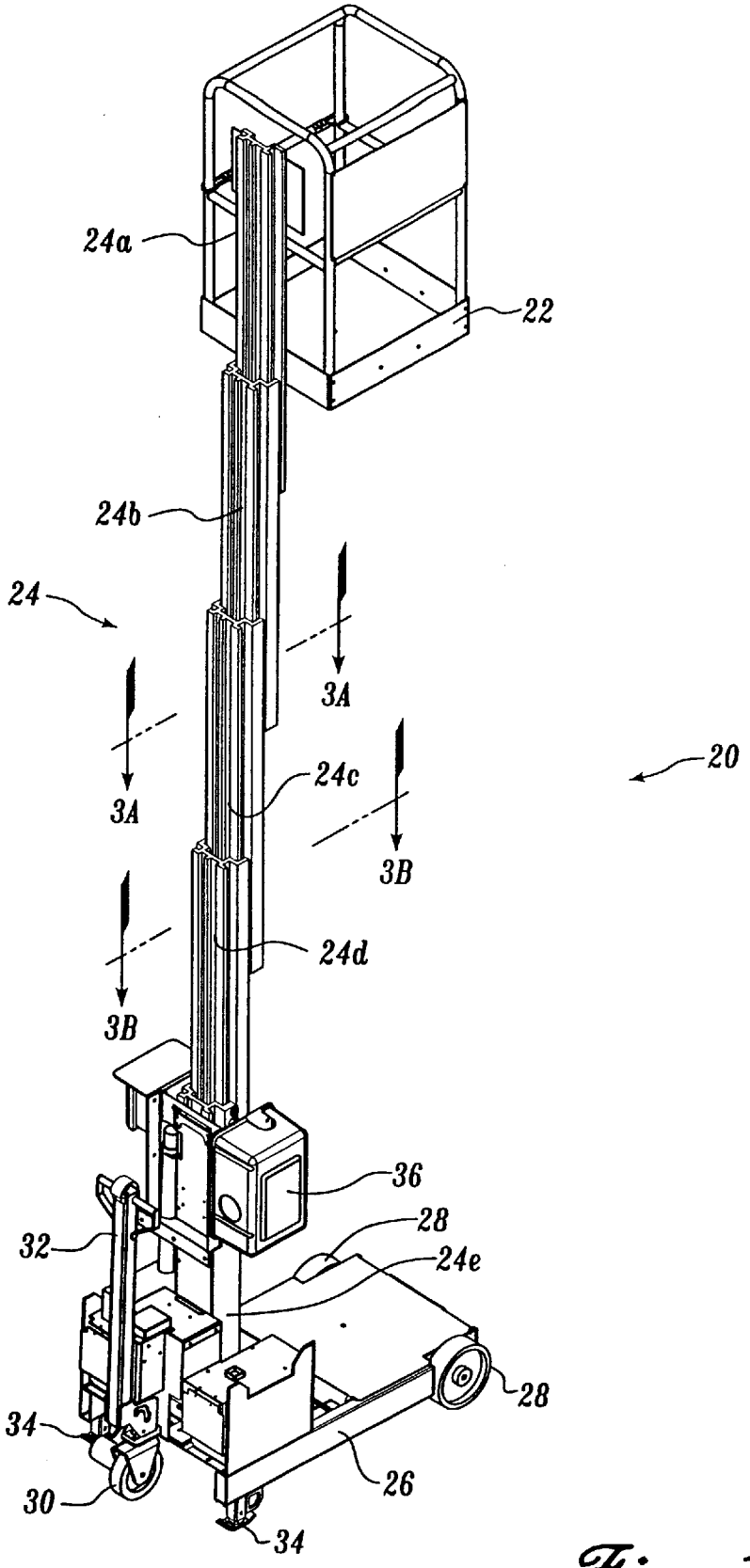
FIG. 1 is a side perspective view of a personnel lift embodying the present invention, with the aerial work platform in a raised position.

Referring now to the drawing in which like reference numerals represent like parts throughout several views, FIG. 1 illustrates a personnel lift 20 embodying the present invention. The personnel lift 20 includes an aerial work platform 22 attached to an upper column 24*a* of a mast 24. The mast 24 includes a vertical tower of nested, telescoping columns 24*a–e*. The bottom column 24*e* of the mast 24 is attached to a base 26 that includes front wheels 28. The rear end of the base 26 includes a transport wheel 30 linked to a handle 32. Support legs 34 are positioned on opposite corners of the rear end of the base 26. A motor 36 located at the base of the mast 24 supplies power to the mast 24 to lift the aerial work platform 22.

Figure 2:
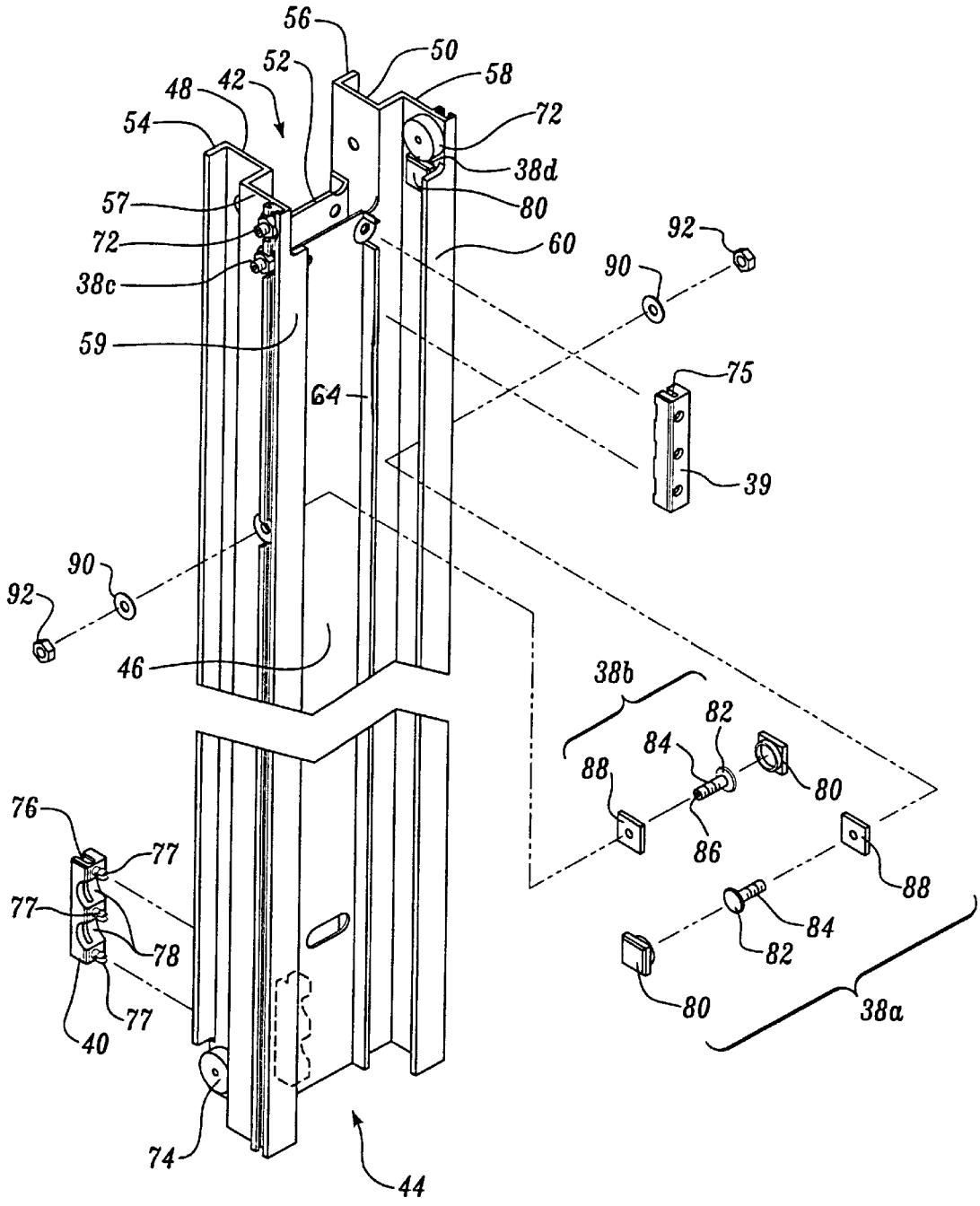
FIG. 2 is an exploded side perspective view of one of the columns for the mast for the personnel lift of FIG. 1.

Briefly described, the present invention is directed to a novel assembly for permitting the columns 24*a–e* to slide smoothly relative to one another that includes shim blocks that are adjustable without requiring that the mast 24 be disassembled. As shown in FIG. 2 and described in detail below, the columns 24*a–e* of the mast 24 include side shim assemblies 38*a–d*, an upper slide block 39, and a lower slide block 40. The side shim assemblies 38*a–d*, which extend between overlapping side edges of the columns 24*a–e*, space the columns an appropriate amount from each other and provide sliding surfaces for one column to slide relative to an adjacent column. The upper and lower slide blocks 39, 40, which are mounted on the front and back of the columns 24*a–e*, assist in aligning the sliding movement of the columns relative to one another. The upper and lower slide blocks 39, 40 also assist in maintaining the alignment of the columns 24*a–e* during the adjustment of the side shim assemblies 38*a–c*.

Figure 3A:
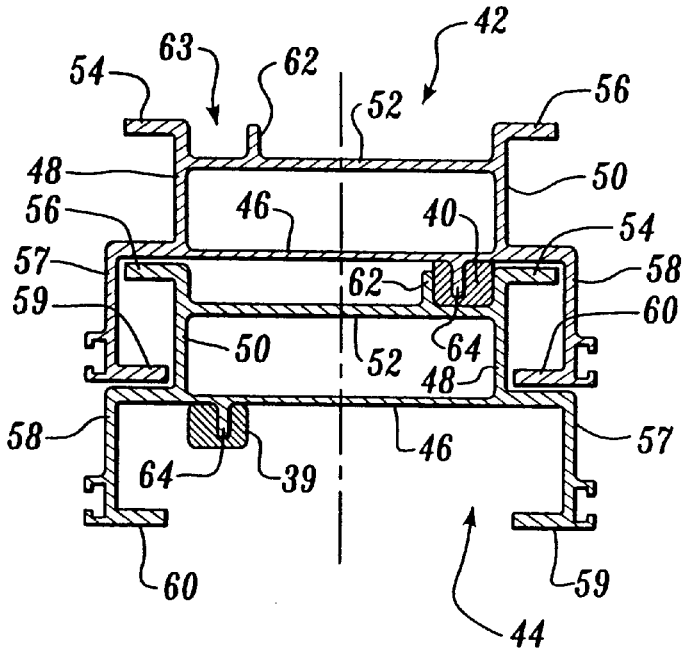
FIG. 3A is a cross-sectional view along line 3A—3A of FIG. 1.
Figure 3B:
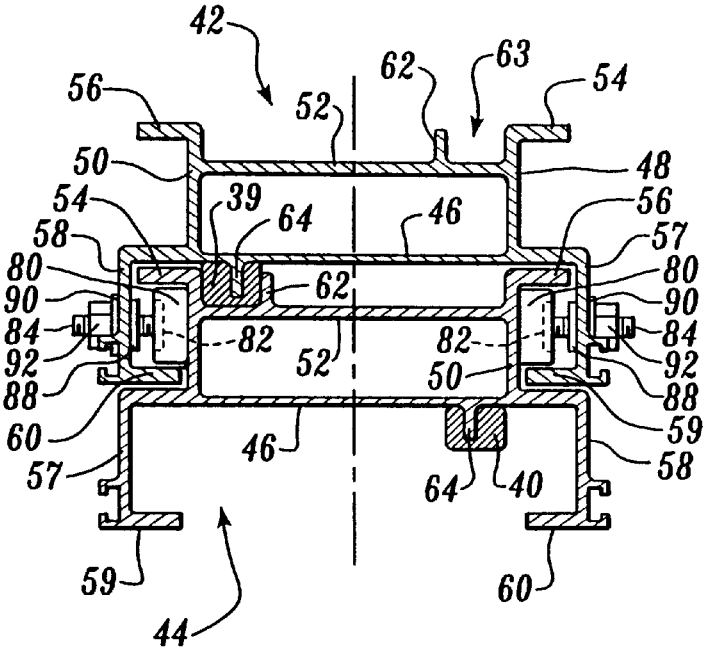
FIG. 3B is a cross-sectional view along line 3B—3B of FIG. 1.

Referring now to FIGS. 2, 3A and 3B, the columns 24*a–e* each include a runner 42 and a track 44. The runner 42 and the track 44 are located on opposite sides of a central web 46. As described below, the runner 42 and the track 44, i.e., each include a number of integral members that extend the length of the columns 24*a–e* and lie perpendicular to each other or to the central web 46. The members are shaped such that the runner 42 of one column 24*a–e* fits into the track 44 of an adjacent column.

Each runner 42 has an H-shaped construction that includes first and second sidewalls 48, 50 connected by a support web 52. One edge of the first and second sidewalls 48, 50 are integral with the central web 46. Two feet 54, 56, which extend outwardly from the opposite edges of the sidewalls 48, 50, respectively, lie parallel to the central web 46. Each track 44 has a U-shaped configuration, the bottom of which is formed by the central web 46. Two outer walls 57, 58, which are integral with and extend from opposite ends of the central web 46, form the rest of the U-shaped configuration. Two inwardly-extending support surfaces 59, 60 are located at the outer edges of the outer walls 57, 58. A first rib 62 extends along the length of the support web 52 of the runner 42 nearer to one foot than to the other. A channel 63 is formed by the sidewall 48, the support web 52, and the first rib 62. A second rib 64 extends along the length of the central web, inside of the track 44 nearer to one of the outer walls than the other outer wall.

The nested columns 24*a–e* are arranged relative to one another such that the runner 42 of a first column is received within the track 44 of an adjacent column. The runner 42 fits within the tracks 44 such that the feet 54, 56 are spaced slightly away from the central web 46 of the adjacent column, just inside the outer walls 57, 58. Likewise, the support surfaces 59, 60 are spaced slightly away from the central web 46 of the adjacent column, just outside the sidewalls 48, 50. The arrangement of the nested columns 24*a–e* is alternated such that the first rib 62 is on the left side of a first column and on the right side of a second column, and so forth. Alternating the arrangement of the columns 24*a–e* also causes the location of the second rib 64 to be alternated. The ribs 62, 64 are arranged so that a second rib on one column will be adjacent to the first rib 62 on an adjacent column, and both of the ribs will be located along one side of the mast 24. The side of the mast 24 on which the ribs 62, 64 are located alternates between the left side of the mast 24 and the right side of the mast.

The columns 24*a–e* include rollers 72, 74 on the top and bottom that facilitate movement of the runners 42 within the track 44. One of the top rollers 72 is attached to each of the outer walls 57 and 58. The top rollers extend into the track 44 and engage the feet 54, 56 of the associated runner 42. One of the bottom rollers 74 is attached to each of the sidewalls 48, 50 of the runner 42. The bottom rollers engage the support surfaces 59, 60 of the associated track 44. The top and bottom rollers 72, 74 are positioned such that when the top rollers 72 and the bottom rollers 74 are in contact with the feet 54, 56 and the support surfaces 59, 60, respectively, the feet 54, 56 of one column are spaced slightly away from the central web 46 of an adjacent column. In addition, the support surfaces 59, 60 of one column are spaced slightly away from the central web 46 of an adjacent column.

The upper slide blocks 39 include a groove 75 that is sized to fit around the second rib 64. An upper slide block 39 is attached to the upper end of the second rib 64 on each column 24*b–e* by any suitable device, such as a bolt (not shown). As best seen in FIG. 3B, the outer surface of the upper slide block 39 is shaped so that it fills the channel 63 formed by the side wall 48, the support web 52, and the first rib 62 of the adjacent column. The upper slide block 39 slides along the channel 63 as the adjacent columns slide relative to one another.

A lower slide block 40 is attached to the bottom back of the central web 46 of each column 24*a–d,* on the surface of the second rib 62. The lower slide block 40 includes a groove 76 extending along its length positioned and sized to receive the second rib 64. The lower slide block 40 includes three prongs 77 that snap into holes (not shown) in the central web 46. A pair of indentations 78, located on the back side of the lower slide block 40, allows access to the lower roller bolt (not shown) through the center web 46. As with the upper slide block 39, the outer surface of the lower slide block 40 is shaped so that it fills the channel 63 formed by the sidewall 48, the support web 52, and the first rib 62 of the adjacent column. As the columns 24*a–e* slide relative to one another, the lower slide block 40 slides along the channel 63, and the upper slide block 39 slides up and down the length of a channel 63 of an adjacent column. The upper and lower slide blocks 39, 40 are preferably made of a nonfriction material, such as Delrin GS, or its equivalent.

Each of the side shim assemblies 38*a–d* includes a shim block 80 mounted on the head 82 of a bolt 84. A hex-key indentation 86 is formed in the distal end of the bolt 84. Each of the side shim assemblies 38*a–d* also includes a shim nut 88 affixed to the inside of one of the outer walls 57, 58. The bolt 84 is threaded onto the shim nut 88 such that the shim block lies in the related track 44 and the distal end of the bolt 84 extends through the outer wall 57 or 58. A washer 90 and a lock nut 92 are mounted on the distal end of the bolt 84, outside the column. The lock nuts are used to lock the shim assemblies 38*a–d* in place. The shim blocks 80 are adjusted inward or outward by loosening the lock nuts 92, placing a hex key (not shown, but known in the art) in the hex-key indentation 86 in the end of a bolt 84 and turning the bolt 84 in the proper direction. In this manner, the bolt 84 and the shim block 80 are adjusted inward against the sidewalls 48, 50 of an adjacent column to hold the columns in alignment. After the shim block 80 is properly adjusted, the lock nut 92 is tightened to hold the related side shim assembly 38*a–d* in place.

Preferably, each column 24*b–e* includes four side shim assemblies 38*a–d*. Two of the side assemblies 38*c* and 38*d* are mounted near the top of the columns 24*b–e*, just below the top rollers 72. The other two side shim assemblies 38*a* and 38*b* are located at the bottom of the overlap region of two columns when the columns are extended the maximum amount. The side shim assemblies 38*a–d*, with some assistance from the upper and lower slide blocks 39, 40, take the side load of the aerial work platform 22 during operation. The upper and lower rollers 72, 74, which are also located in this overlap region, prevent fore and aft movement of the columns 24*a–e*. The upper and lower slide blocks 39, 40, which are also located in this overlap region during full extension of the columns, also assist in preventing side to side and fore and aft motion. Locating all of these devices in the overlap region provides the maximum amount of support when the mast is filly extended.

If the shim blocks 80 on one or more of the columns 24*a–e* begin to wear to the point that there is a loose feeling between the columns, the pressure of the side shim assemblies 38*a–d* against the adjacent sidewalls 48, 50, can be adjusted to tighten the mast 24. Because the hex-key pattern 86 is located on the outside of the outer walls 57, 58, this adjustment may be made without disassembly of the mast 24. Thus, adjustments can be accomplished without significant down time. The outside access of the adjustment mechanism for the side shim assemblies 38*a–c* also permits easier assembly of the columns 24*a–e*. After the columns 24*a–e* are somewhat loosely assembled, the side shim assemblies 38*a–d* are tightened into place.

The side shim assemblies 38*a–d* work in conjunction with the upper and lower slide blocks 39, 40 in that the slide blocks maintain the columns in line while the side shim assemblies are being tightened. The slide blocks 39, 40 limit side-to-side movement of the columns 24*a–e* so that the side shim assemblies 38*a–d* cannot be overadjusted and press the columns out of line. This ensures that each column 24*a–e* maintains substantial alignment with the adjacent columns. The upper and lower slide blocks 39–40 slide in the channel 63 formed between the sidewalls 48, the support webs 52 of one column, and the first rib 62 on the adjacent column surface during the raising and lowering of the aerial work platform 22. Over time, the sliding action wears the shim blocks 80 giving the mast 24, and, therefore, the aerial work platform 22, a loose feeling. When this occurs, a service technician can adjust the side shim assemblies 38*a–d* by loosening the lock nuts 92 and rotating the bolts 84 to move the shim blocks 80 inwardly, without having to disassemble the mast 24.

While the preferred embodiment of the invention has been illustrated and described, it will be appreciated that various changes can be made therein without departing from the spirit and scope of the invention as described in the appended claims.

What is claimed is:

1. An extendible mast system comprising:

(a) a first column having two outer sidewalls;

(b) a second column having two sidewalls that are received within and adapted to slide within the outer sidewalls of the first column, the first and second columns being arranged front-to-back so that translational movement of the first column relative to the second column causes extension of the mast system, said second column including a plurality of webs extending between the two sidewalls of said second column;

(c) a first shim block operatively associated with one of the outer sidewalls of the first column and adapted to slide against the surface of one of the sidewalls of the second column as the second column is translated relative to the first column, the first shim block maintaining contact with and sliding along the surface of the one of the sidewalls of the second column during the translational movement of the second column relative to the first column, the contact of the shim block with the one of the sidewalls of the second column substantially preventing movement of at least a portion of the second column relative to at least a portion of the first column during translational movement of the two columns in a first direction that is substantially sideways relative to the front-to-back arrangement of the columns;

(d) a first adjustment mechanism that is capable of moving the first shim block toward and away from the one of the sidewalls of the second column the first adjustment mechanism being accessible from the outside of said one of the outer sidewalls of the first column when the extendible mast system is fully assembled;

(e) a first slide surface extending along the length of one of the first and the second columns; and (f) a first slide block attached to the other of the first and the second columns, the first slide block being designed to slide along the first slide surface, said first slide surface being a rib formed in one of said plurality of webs and wherein said first slide block includes a channel in which said rib slides.

2. The extendible mast system of claim 1, further comprising:

(a) a second shim block operatively associated with the other of the outer sidewalls of the first column and adapted to slide against the surface of the other of the sidewalls of the second column as the second column is translated relative to the first column, the second shim block maintaining contact with and sliding along the surface of the other of the sidewalls of the second column during the translational movement of the second column relative to the first column, the contact of the second shim block with the other of the sidewalls of the second column substantially preventing movement of at least a portion of the first column relative to at least a portion of the second column during translational movement of the two columns in a second direction that is substantially sideways relative to the front-to-back arrangement of the columns, the second direction being substantially opposite the first direction; and (b) a second adjustment mechanism that is capable of moving the second shim block toward and away from the other of the sidewalls of the second column, the second adjustment mechanism being accessible from the outside of the said other of the sidewalls of the first column when the extendible mast system is fully assembled.

3. The extendible mast system claimed in claim 2, wherein said first slide block it, located near one end of said other of the first and second columns and wherein said extendible mast system further comprises a second slide block attached to the other of the first and second columns, said second slide block located near the other end of said other of the first and second columns, the second slid block being designed to slide along the first slide surface.

4. The extendible mast system claimed in claim 2, wherein said first and second shim blocks are located near one end of said first column and wherein said extendible mast system further comprises:

a third shim block operatively associated with said one of the outer sidewalls of the first column spaced inwardly from said first shim block and adapted to slide against the surface of said one of the sidewalls of the second column as the second column is translated relative to the first column, the third shim block maintaining contact with and sliding along the surface of the one of the sidewalls of the second column during the translational movement of the second column relative to the first column, the contact of the third shim block with the one of the sidewalls of the second column substantially preventing movement of at least a portion of the second column relative to at least a portion of the first column during translational movement of the two columns in a first direction that is substantially sideways relative to the front-to-back arrangements of the columns;

a third adjustment mechanism that is capable of moving the third shim block toward and away from the one of the sidewalls of the second column, the third adjustment mechanism being accessible from the outside of said one of the outer sidewalls of the first column when the extendible mast system is fully assembled;

a fourth shim block operatively associated with said other of the outer sidewalls of the first column spaced inwardly from said second shim block and adapted to slide against the surface of said other of the sidewalls of the second column as the second column is translated relative to the first column, the fourth shim block maintaining contact with and sliding along the surface of the other of the sidewalls of the second column during the translational movement of the second column relative to the first column, the contact of the fourth shim block with the other of the sidewalls of the second column substantially preventing movement of at least a portion of the second column relative to at least a portion of the first column during translational movement of the two columns in said second direction that is substantially sideways relative to the front-to-back arrangements of the columns; and a fourth adjustment mechanism that is capable of moving the fourth shim block toward and away from the other of the sidewalls of the second column, the second adjustment mechanism being; accessible from the outside of said other of the outer sidewalls of the first column when the extendible mast system is fully assembled.

5. The extendible mast system claimed in claim 4, wherein said first slide block is located near one end of said other of the first and second columns and wherein said extendible mast system further comprises a second slide block attached to the other of the first and second columns, said second slide block located near the other end of said other of said first and second columns, the second slide block being designed to slide along the first slide surface.

6. The extendible mast system claimed in claim 1, wherein said first slide block is located near one end of said other of the first and second columns and wherein said extendible mast system further comprises a second slide block attached to the other of the first and second columns, said second slide block located near the other end of said other of the first and second columns, the second slide block being designed to slide along the first slide surface.

7. The extendible mast system claimed in claim 1, wherein said first shim block is located near one end of said first column and wherein said extendible mast system further comprises:

a second shim block operatively associated with said one of the outer sidewalls of the first column spaced inwardly from said first shim block and adapted to slide against the surface of said one of the sidewalls of the second column as the second column is translated relative to the first column, the second shim block maintaining contact with and sliding along the surface of the one of the sidewalls of the second column during the translational movement of the second column relative to the first column, the contact of the second shim block with the one of the sidewalls of the second column substantially preventing movement of at least a portion of the second column relative to at least a portion of the first column during translational movement of the two columns in a first direction that is substantially sideways relative to the front-to-back arrangements of the columns; and a second adjustment mechanism that is capable of moving the second shim block toward and away from the one of the sidewalls of the second column, the second adjustment mechanism being accessible from the outside of said one of the outer sidewalls of the first column when the extendible mast system is fully assembled.

8. The extendible mast system claimed in claim 7, wherein said first slide block is located near one end of said other of the first and second columns and wherein said extendible mast system fur her comprises a second slide block attached to the other of the first and second columns, said second slide block located near the other end of said other of said first and second columns, the second slide block being designed to slide along the first slide surface.

9. An extendible mast system comprising:

(a) a first column having two outer sidewalls;

(b) a second column having two sidewalls that are received within and adapted to slide along the outer sidewalls of the first column, the columns being aligned back-to-front and arranged so that translational movement of the first column relative to the second column causes extension of the mast system, said second column including a plurality of webs extending between the two sidewalls of said second column;

(c) a first shim block operatively associated with one of the outer sidewalls of the first column and adapted to slide against a surface of one of the sidewalls of the second column as the second column is translated relative to the first column, the first shim block maintaining contact with and sliding along the surface of the one of the sidewalls of the second column during the translational movement of the second column relative to the first column;

(d) a second shim block operatively associated with the other of the outer sidewalls of the first column and adapted to slide against a surface of the other of the sidewalls of the second column as the second column is translated relative to the first column, the second shim block maintaining contact with and sliding along the surface of the other of the sidewalls of the second column during the translational movement of the second column relative to the first column;

(e) a first adjustment mechanism that is capable of moving the first shim block toward and away from the one of the sidewalls of the second column, the first adjustment mechanism being accessible from the outside of said one of the sidewalls of the first column when the extendible mast system is fully assembled;

(f) a second adjustment mechanism that is capable of moving the second shim block toward and away from the other of the sidewalls of the second column, the second adjustment mechanism being accessible from the outside of said other of the sidewalls of the first column when the extendible mast system is fully assembled;

(g) a first slide surface extending along the length of one of the first and the second columns, and (h) a first slide block attached to the other of the first and the second columns, the first slide block being designed to slide along the first side surface, the sliding contact between the first slide surface and the first slide block substantially preventing movement of at least a portion of the first column relative to at least a portion of the second column in a first direction that is substantially sideways relative to the back-to-front alignment of the columns, said first slide surface being a rib formed in one of said plurality of webs and wherein said first slide block includes a channel in which said rib slides.

10. The extendible mast system of claim 9, wherein the first shim block is mounted on the head of a first bolt, and the first adjustment mechanism comprises the first bolt and a tool receiving pattern located at the end of the first bolt distal from the head of the first bolt.

11. The extendible mast system of claim 10, wherein the second shim block is mounted on the head of a second bolt, and the second adjustment mechanism comprises the second bolt and a tool receiving pattern located at the end of the second bolt distal from the head of the second bolt.

12. The extendible mast system claimed in claim 9, wherein said first and second shim blocks are located near one end of said first column and wherein said extendible mast system further comprises:

a third shim block operatively associated with said one of the outer sidewalls of the first column spaced inwardly from said first shim block and adapted to slide against the surface of said one of the sidewalls of the second column as the second column is translated relative to the first column, the third shim block maintaining contact with and sliding along the surface of the one of the sidewalls of the second column during the translational movement of the second column relative to the first column;

a third adjustment mechanism that is capable of moving the third shim block toward and away from the one of the sidewalls of the second column, the third adjustment mechanism being accessible from the outside of said one of the outer sidewalls of the first column when the extendible mast system is fully assembled;

a fourth shim block operatively associated with said other of the outer sidewalls of the first column spaced inwardly from said second shim block and adapted to slide against the surface of said other of the sidewalls of the second column as the second column is translated relative to the first column, the fourth shim block maintaining contact with and sliding along the surface of the other of the sidewalls of the second column during the translational movement of the second column relative to the first column; and a fourth adjustment mechanism that is capable of moving the fourth shim block toward and away front the other of the sidewalls of the second column, the fourth adjustment mechanism being accessible from the outside of said other of the outer sidewalls of the first column when the extendible mast system is fully assembled.

13. The extendible mast system of claim 12, wherein the first shim block is mounted on the head of a first bolt, the second shim block is mounted on the head of a second bolt, the first adjustment mechanism comprises the first bolt and a tool receiving pattern located at the end of the first bolt distal from the head of the first bolt, and the second adjustment mechanism comprises the second bolt and a tool receiving pattern located at the end of the second bolt distal from the head of the second bolt.

14. The extendible mast system of claim 13, wherein the third shim block is mounted on the head of a third bolt, the fourth shim block is mounted on the head of a fourth bolt, the third adjustment mechanism comprises the third bolt and a tool receiving pattern located at the end of the third bolt distal from the head of the third bolt, and the fourth adjustment mechanism comprises the fourth bolt and a tool receiving pattern located at the end of the fourth bolt distal from the head of the fourth bolt.

15. The extendible mast system claimed in claim 9, wherein said first slide block is located near one end of said other of the first and second columns and wherein said extendible mast system further comprises a second slide block attached to the other of the first and second columns, said second slide block located near the other end of said other of the first and second columns, the second slide block being designed to slide along the first slide surface.

* * * * *

UNITED STATES PATENT AND TRADEMARK OFFICE

CERTIFICATE OF CORRECTION

PATENT NO. : 6,095,286
DATED : August 1, 2000
INVENTOR(S) : Steven D. Citron et al.

It is certified that error appears in the above-identified patent and that said Letters Patent is hereby corrected as shown below:

Column 5,
Line 63, “filly” should be -- fully --;

Column 7,
Line 37, “it,” should be -- is --;
Line 40, insert -- web of the -- before “other”;
Line 42, “slid” should be -- slide --;

Column 8,
Line 21, delete semicolon;
Lines 29 and 37, insert -- web of the -- before “other”;

Column 9,
Line 2, “fur her” should be -- further --;
Line 3, insert -- web of the -- before “other”;
Line 49, comma should be semicolon;
Lines 62 and 67, insert -- non-rotatably mounted -- before “shim”;

Column 10,
Lines 8, 13, 19,24, 29, 35, 51 and 52, insert -- non-rotatably mounted -- before “shim”;
Line 10, insert -- , said third non-rotatably mounted shim block having a flat surface -- after “block”;
Lines 10 and 26, delete “and”;
Line 26, insert -- , said fourth non-rotatably mounted shim block having a flat surface -- after “block”;
Line 35, “front” should be -- from --;

Signed and Sealed this

Eighteenth Day of March, 2003

JAMES E. ROGAN
*Director of the United States Patent and Trademark Office*